US007587791B2

(12) United States Patent
Liou

(10) Patent No.: US 7,587,791 B2
(45) Date of Patent: Sep. 15, 2009

(54) TOOL

(76) Inventor: Mou-Tang Liou, No. 25, Lane 86, Ta Wei Road, Taichung Hsien, Ta Li City (TW)

( * ) Notice: Subject to any disclaimer, the term of this patent is extended or adjusted under 35 U.S.C. 154(b) by 457 days.

(21) Appl. No.: 11/306,993

(22) Filed: Jan. 18, 2006

(65) Prior Publication Data

US 2007/0163084 A1 Jul. 19, 2007

(51) Int. Cl.
*B25G 1/10* (2006.01)

(52) U.S. Cl. ..... 16/436; 16/422; 81/177.1

(58) Field of Classification Search ..... 16/436, 16/422, 429, 405, 113.1; 81/177.2, 117.4, 81/117.8, 177.85, 437, 439, 490, 438; 30/162, 30/322, 342, 339, 160, 163, 323, 340
See application file for complete search history.

(56) References Cited

U.S. PATENT DOCUMENTS 1,269,413 A * 6/1918 Finnigan ..... 81/177.2
1,457,570 A * 6/1923 Guthard ..... 81/177.5
1,484,379 A * 2/1924 Rainey ..... 81/177.1
2,674,286 A * 4/1954 Carson ..... 81/177.4
2,682,414 A * 6/1954 Richardson ..... 279/77
4,328,721 A * 5/1982 Massari ..... 81/439
4,409,866 A * 10/1983 McBride ..... 81/177.2
4,512,381 A * 4/1985 Alvarez ..... 81/20
4,581,961 A * 4/1986 Lai ..... 81/439
5,481,949 A * 1/1996 Yen ..... 81/438
6,374,500 B2 * 4/2002 Stein et al. ..... 30/342
6,725,749 B1 * 4/2004 Liou ..... 81/438

OTHER PUBLICATIONS

Taiwanese Patent Publication No. 554796, Sep. 21, 2003, 4 pages.

* cited by examiner

*Primary Examiner*—Chuck Y. Mah
(74) *Attorney, Agent, or Firm*—Alan Kamrath; Kamrath & Associates PA

(57) ABSTRACT

A tool includes a handle, a controller and a bit. The handle includes a socket defining an axial non-circular space and a radial space in communication with the axial space. The controller includes a space defined therein and a ridge formed on the wall of the space thereof. The controller is movable in the radial space of socket between a locking position and a releasing position. The bit includes a working tip and a shank defining at least one recess for receiving the ridge when the shank is inserted into the space of the controller through the axial space of the socket, thus locking the bit to the handle.

19 Claims, 12 Drawing Sheets

TOOL

BACKGROUND OF INVENTION

1. Field of Invention

The present invention relates to a tool and, more particularly, to a tool including a chuck for engagement with a bit.

2. Related Prior Art

Disclosed in Taiwanese Patent Publication No.554796 is a tool including a chuck 20 for engagement with a bit 40. The chuck 20 includes a socket 21, a ball 24 and two rings 26 and 28. The rings 26 and 28 can be rotated on the socket 21 so as to move the ball 24 longitudinally and peripherally on the socket 21 so that the bit 40 can be engaged with and disengaged from the chuck 20. The tool includes a lot of components and forms a complicated structure. Moreover, a user has to operate the chuck 20 with two hands.

The present invention is therefore intended to obviate or at least alleviate the problems encountered in the prior art.

SUMMARY OF INVENTION

According to the present invention, a tool includes a handle, a controller and a bit. The handle includes a socket defining an axial non-circular space and a radial space in communication with the axial space. The controller includes a space defined therein and a ridge formed on the wall of the space thereof The controller is movable in the radial space of the socket between a locking position and a releasing position. The bit includes a working tip and a shank defining at least one recess for receiving the ridge when the shank is inserted into the space of the controller through the axial space of the socket, thus locking the bit to the handle.

An advantage of the tool according to the present invention is its small number of elements and simple structure.

Another advantage of the tool according to the present invention is that a user can easily operate the tool with only one hand.

Other advantages and features of the present invention will become apparent from the following description referring to the drawings.

BRIEF DESCRIPTION OF DRAWINGS

The present invention will be described through detailed illustration of three embodiments referring to the drawings.

DETAILED DESCRIPTION OF PREFERRED EMBODIMENTS

Figure 1:
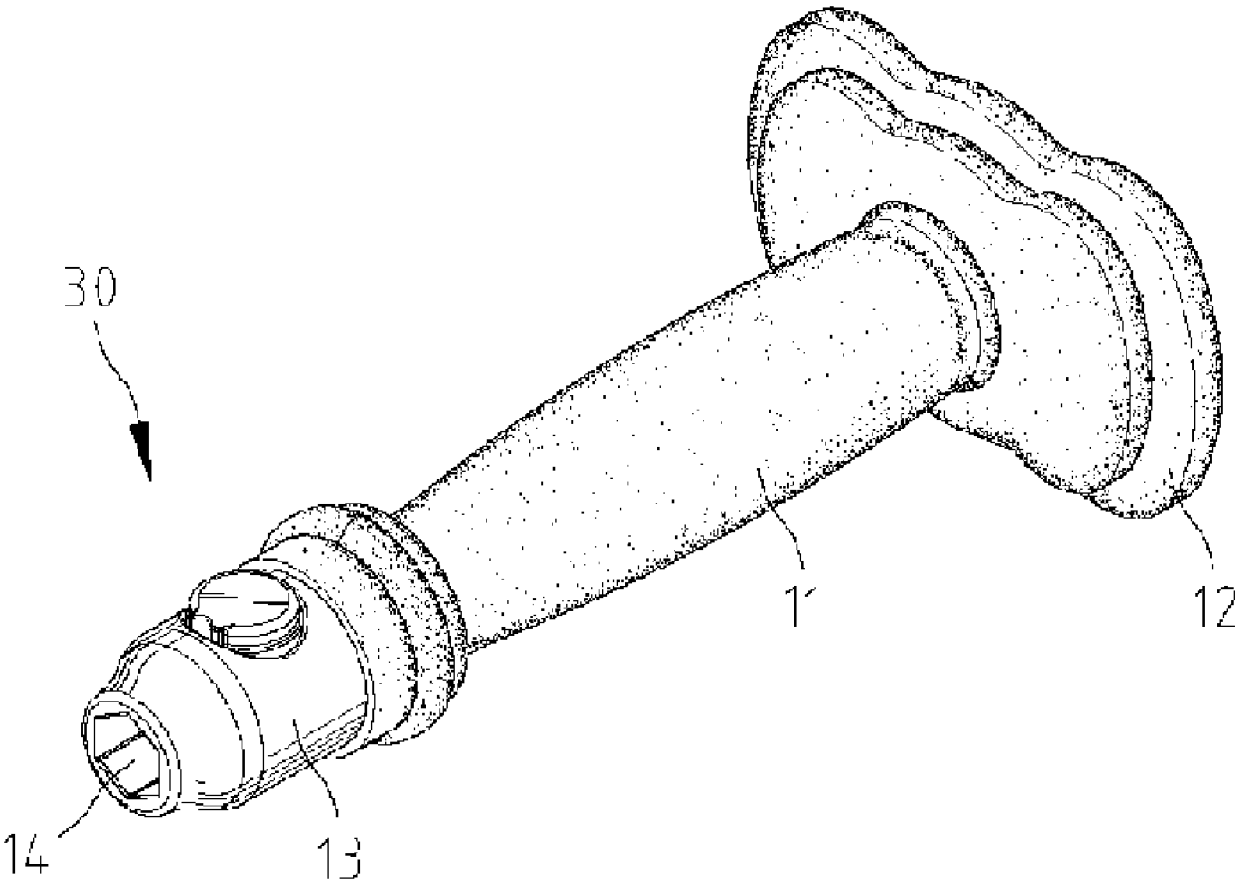
FIG. 1 is a perspective view of a tool according to the first embodiment of the present invention.

Referring to FIG. 1, there is shown a tool 10 according to a first embodiment of the present invention. The tool 10 includes a handle 11, an anvil 12 formed at an end of the handle 11 and a socket 13 formed at an opposite end of the handle 11. The anvil 12 is for encountering a hammer. The anvil 12 includes a large area for protecting a user's hand from the hammer. A controller 30 is installed on the socket 13.

Figure 2:
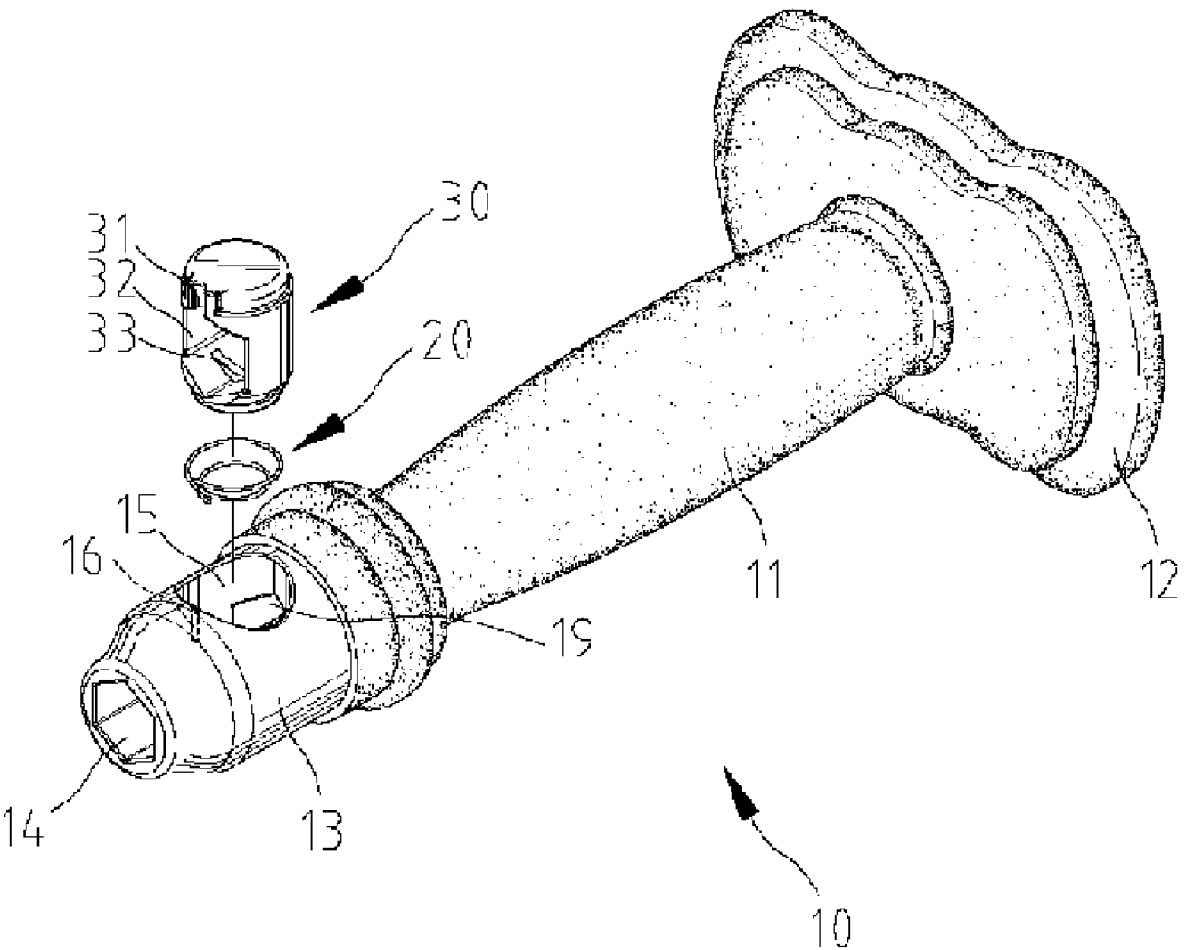
FIG. 2 is an exploded view of the tool shown in FIG. 1.
Figure 3:
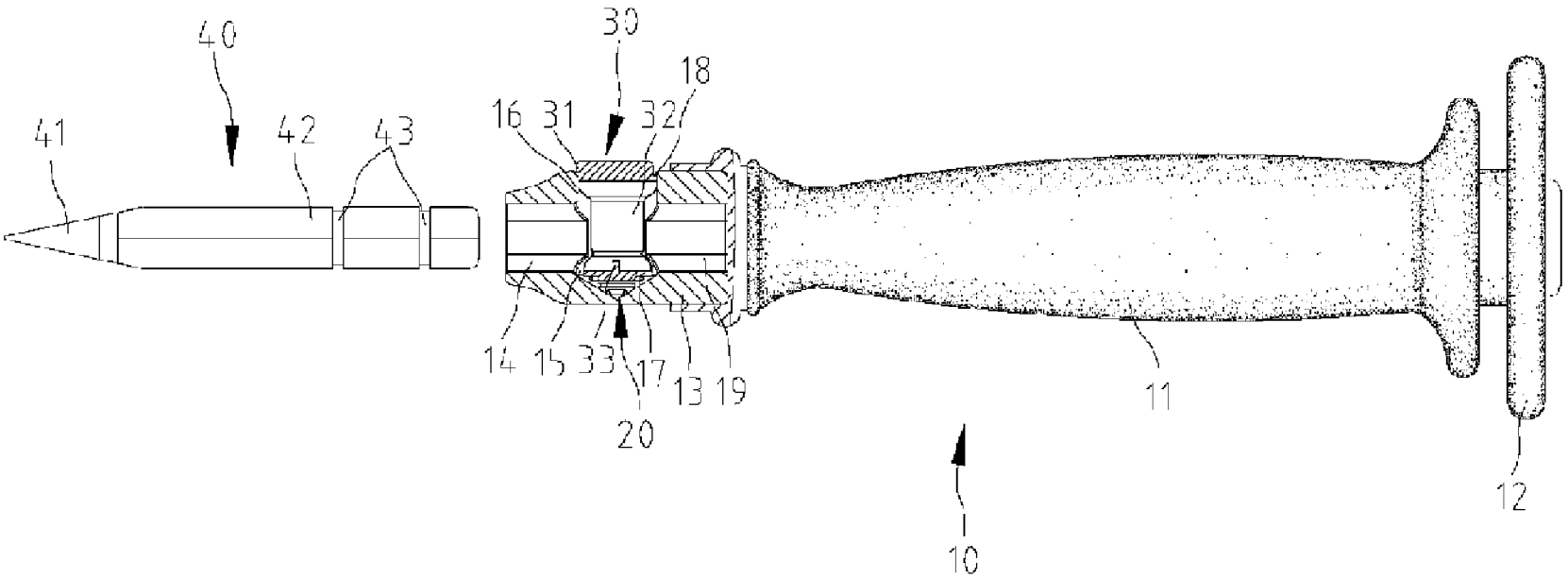
FIG. 3 is a cross-sectional view of the tool shown in FIG. 1.

Referring to FIGS. 2 and 3, the socket 13 defines a first axial non-circular space 14, a second axial non-circular space 19, a radial space 15 for communicating the first axial non-circular space 14 with the second axial non-circular space 19 and a radial taper cavity 17 in communication with the radial space 15. Preferably, the axial non-circular spaces 14 and 19 are hexangular spaces. The radial taper cavity 17 is made by a tip of a drill. In another embodiment, a radial flat-bedded cavity may be made instead of the radial taper cavity 17 if milling is adopted instead of drilling. A ridge 16 is formed on the wall of the radial space 15.

An elastic element 20 is located in the radial taper cavity 17. The elastic element 20 includes a configuration corresponding to the radial taper cavity 17.

The controller 30 includes a first end located in the radial space 15 of the socket 13 and a second end exposed from the radial space 15 of the socket 13. The second end of the controller 30 is located against the elastic element 20. A user can push the controller 30 by the second end. The controller 30 defines, near the second end, a recess 31 for receiving the ridge 16 so that the controller 30 cannot rotate in the radial space 15 of the socket 13. In another embodiment, the positions of the recess 31 and the ridge 16 can be exchanged. In still another embodiment, the recess 31 and the ridge 16 can be omitted if the controller 30 and the radial space 15 are non-circular. The controller 30 includes, near the second end, a shoulder restrained by a restraint 18 formed on the socket 13. The restraint 18 is made by hammering a portion of the socket 13 near the radial space 15. The controller 30 defines a space 32 corresponding to the axial non-circular spaces 14 and 19. A ridge 33 is formed on the floor of the space 32.

A bit 40 includes a working tip 41 and a shank 42. A plurality of annular grooves 43 is defined in the shank 42 of the bit 40. The working tip 41 is in the form of a chisel.

Figure 4:
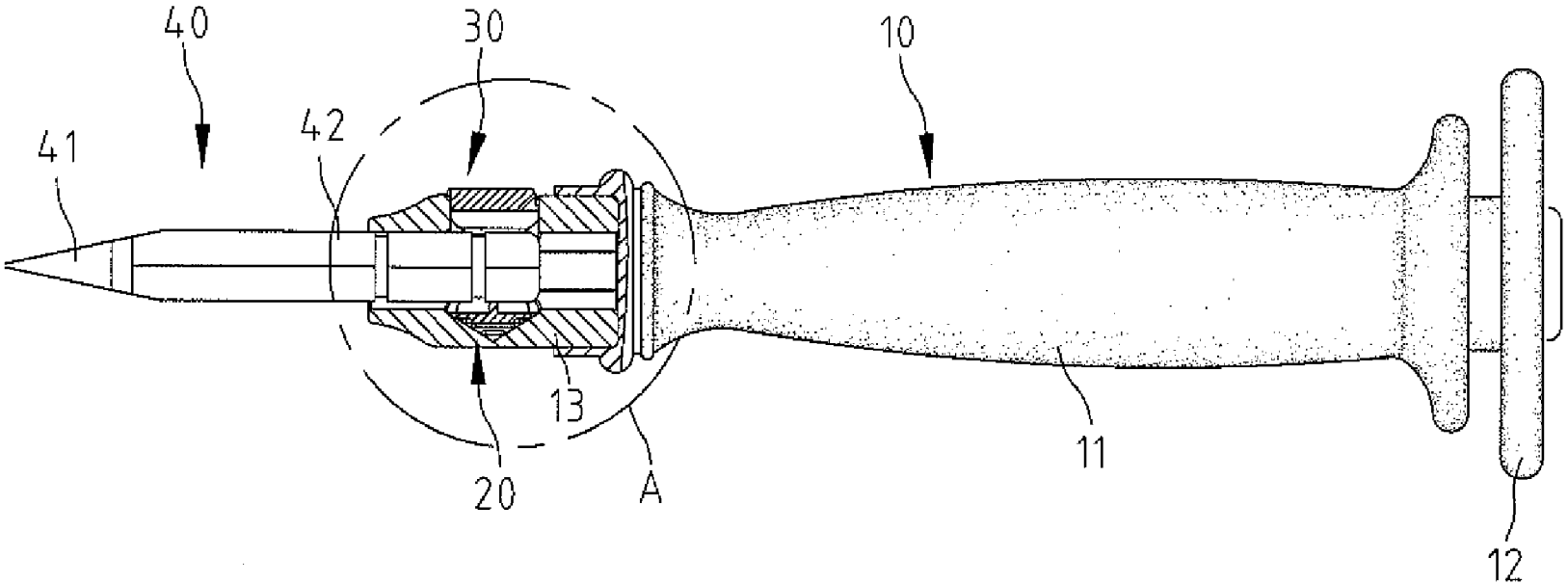
FIG. 4 is a cross-sectional view of the tool in another position than shown in FIG. 3.
Figure 4A:
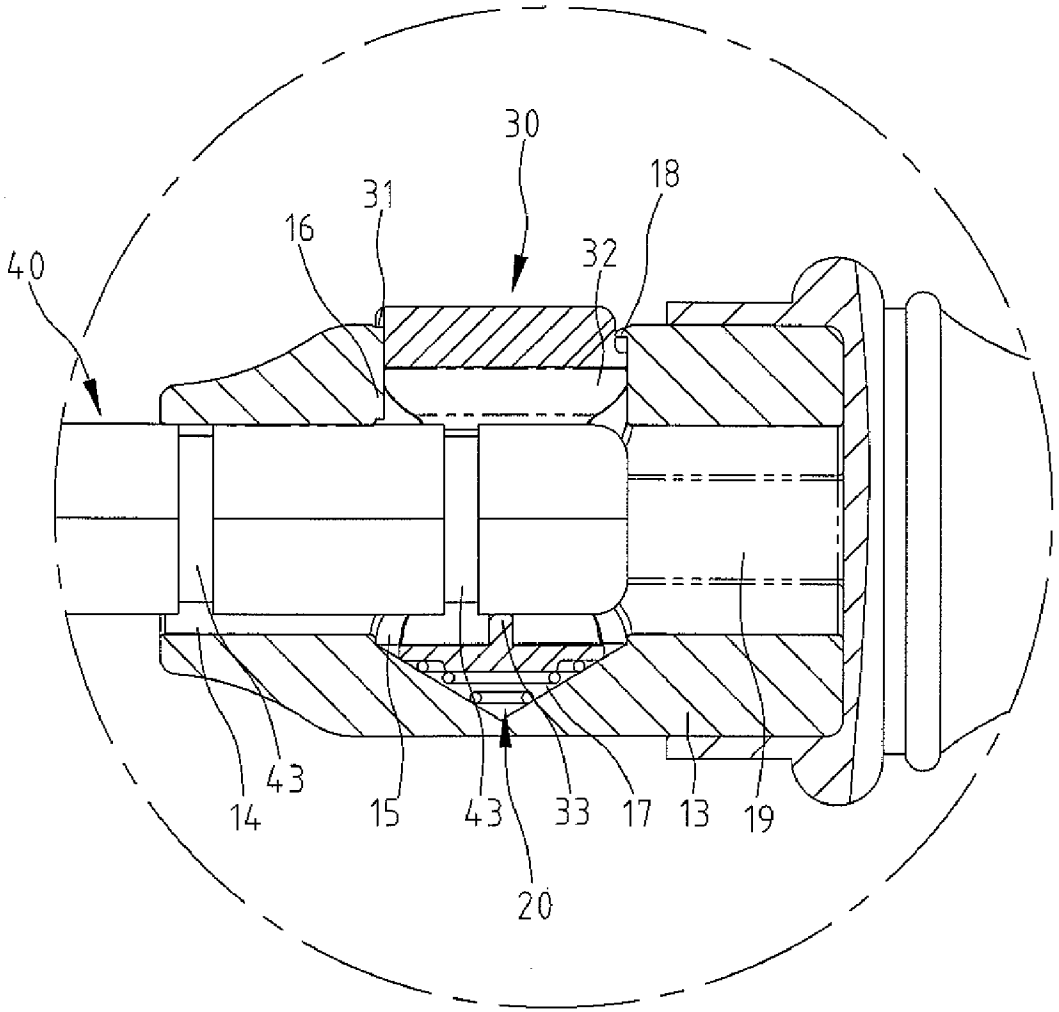
FIG. 4A is an enlarged, cross-sectional view of the tool in the encircled area A of FIG. 4.

Referring to FIG. 4, the shank 42 of the bit 40 is inserted into the space 32 of the controller 30 through the first axial non-circular space 14 of the socket 13. The shank 42 of the bit 40 pushes down the ridge 33, thus lowering the controller 30 and compressing the elastic element 20.

Figure 5:
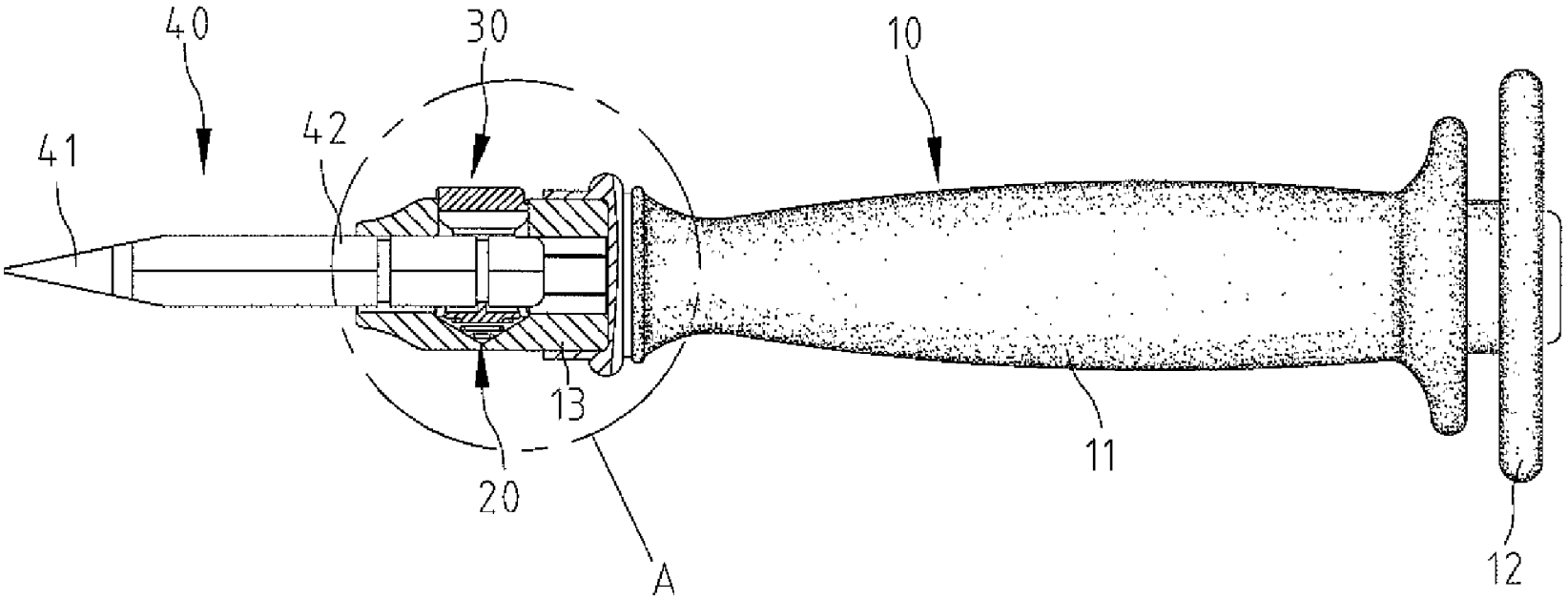
FIG. 5 is a cross-sectional view of the tool in another position than shown in FIG. 4.
Figure 5A:
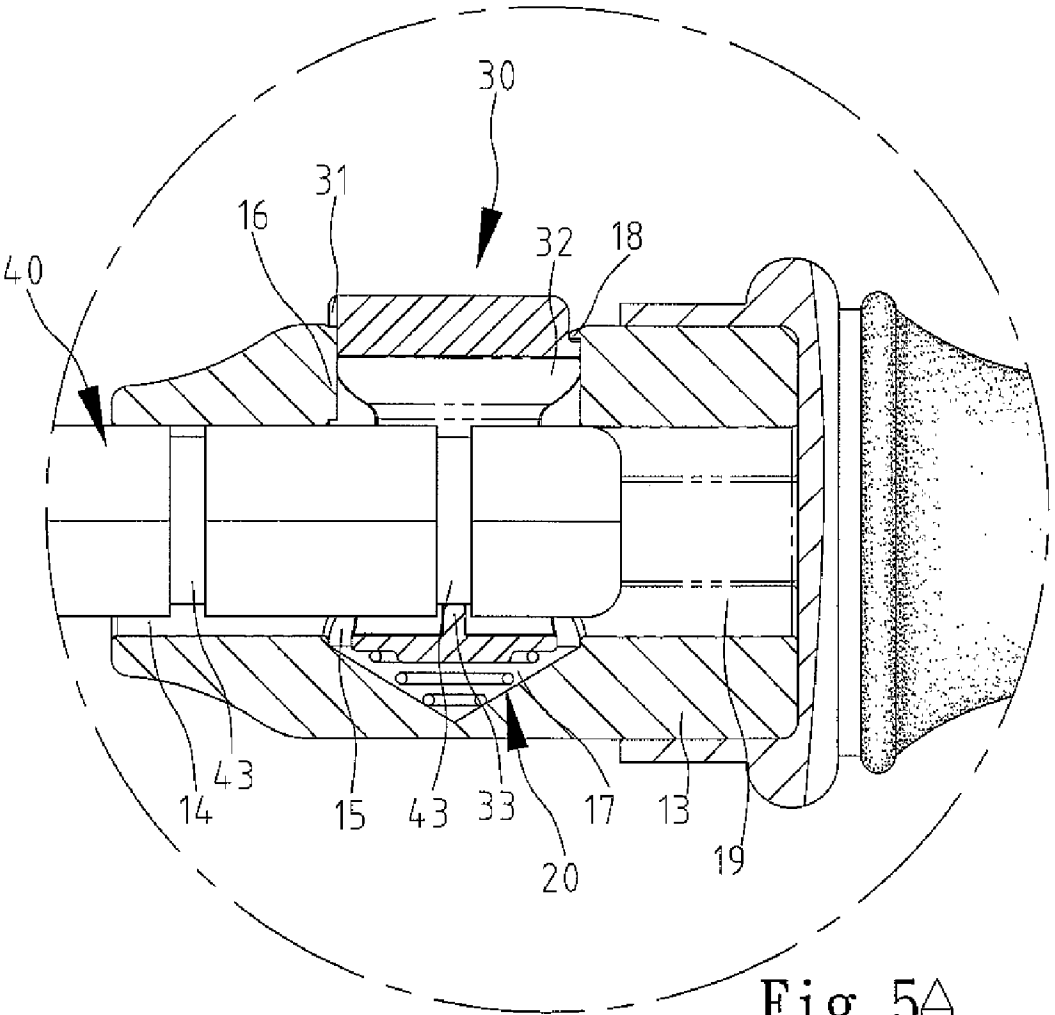
FIG. 5A is an enlarged, cross-sectional view of the tool in the encircled area A of FIG.5.

Referring to FIG. 5, one of the annular grooves 43 finally reaches the ridge 33. The elastic element 20 lifts the controller 30 so that the ridge 33 enters the annular groove 43. Therefore, the bit 40 is locked to the socket 13.

Figure 6:
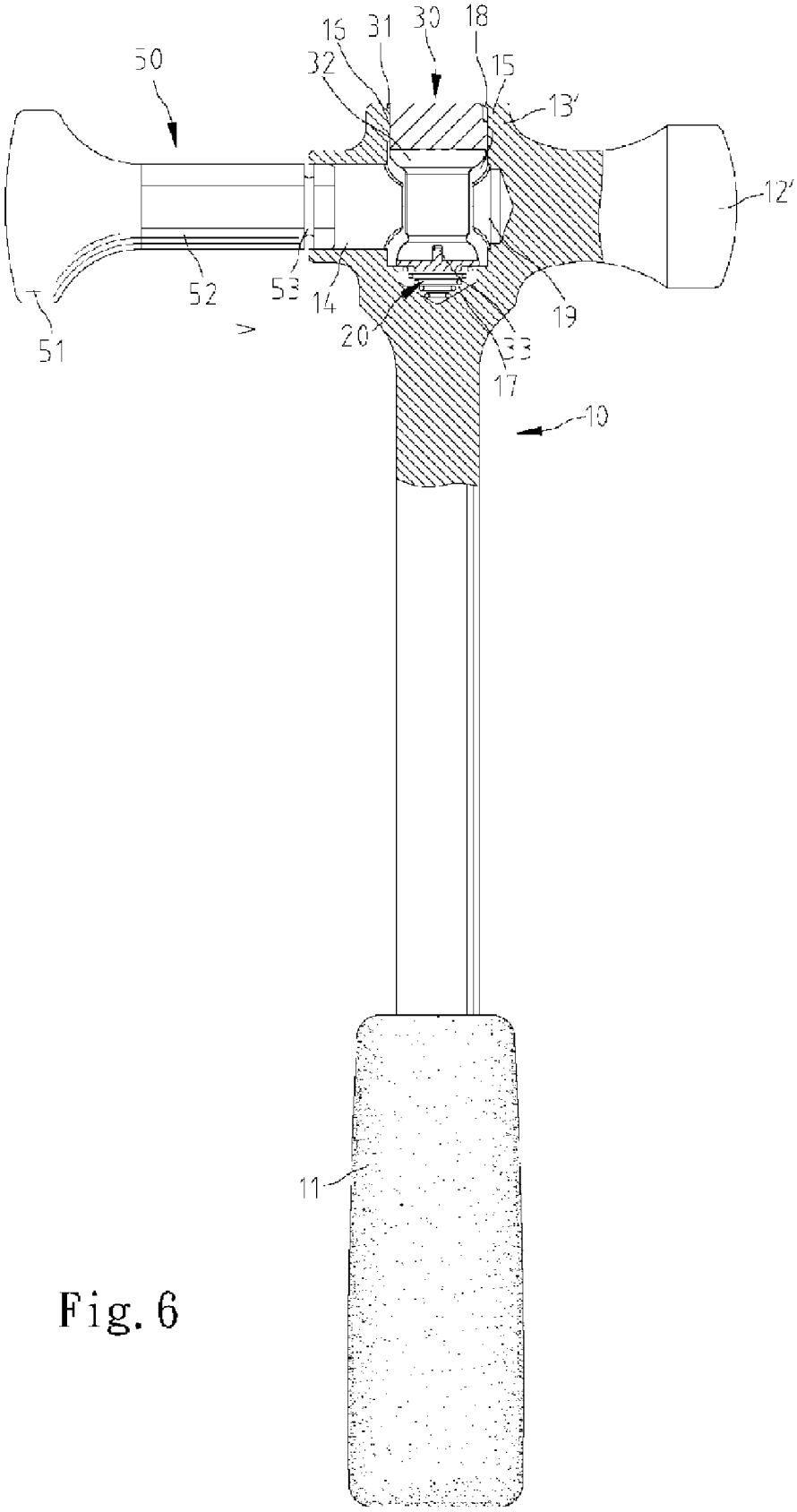
FIG. 6 is a cutaway view of a tool according to the second embodiment of the present invention.
Figure 7:
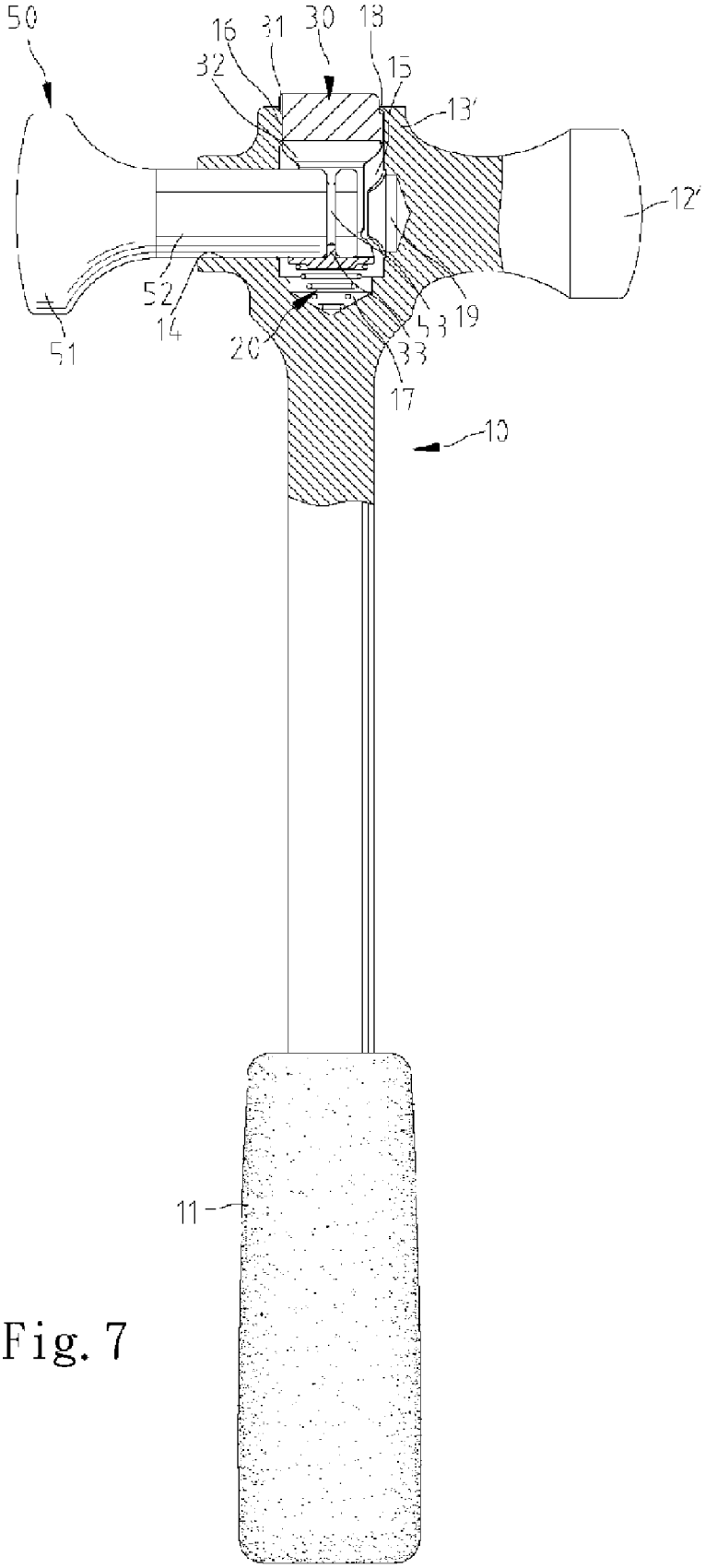
FIG. 7 is a cutaway view of the tool in another position than shown in FIG. 6.

Referring to FIGS. 6 and 7, there is shown a tool according to a second embodiment of the present invention. The second embodiment is like the first embodiment except for several things. Firstly, the axis of the socket 13' is perpendicular to that of the handle 11. Secondly, a hammer 12' is used instead of the anvil 12. Thirdly, a bit 50 is used instead of the bit 40. The bit 50 includes a working tip 51 in the form of a hammer and a shank 52. An annular groove 53 is defined in the shank 52 of the bit 50.

Figure 8:
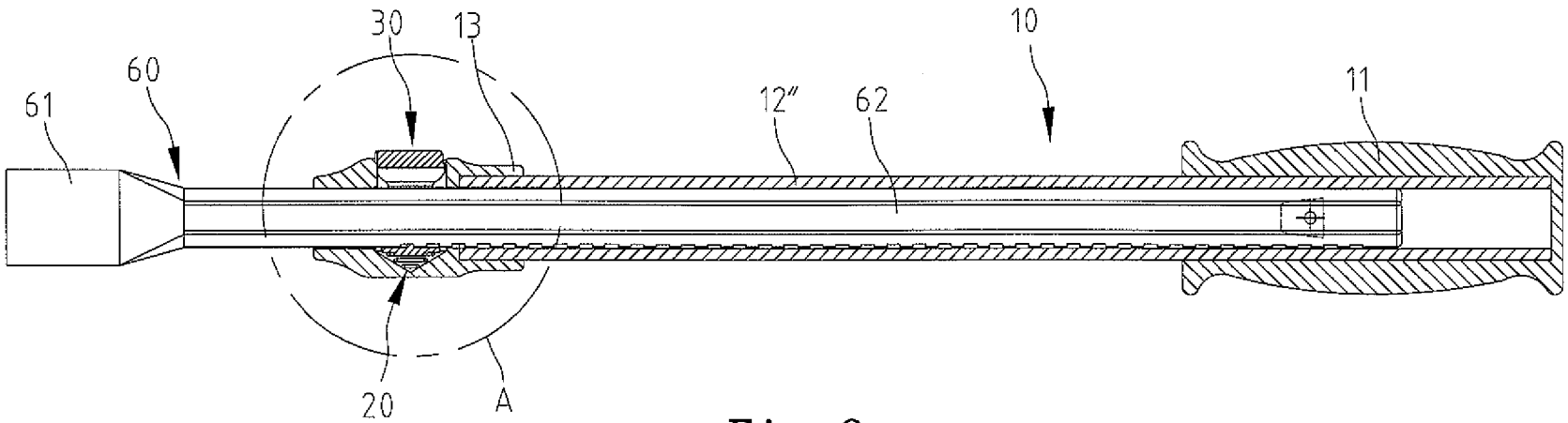
FIG. 8 is a cross-sectional view of a tool according to the third embodiment of the present invention.
Figure 8A:
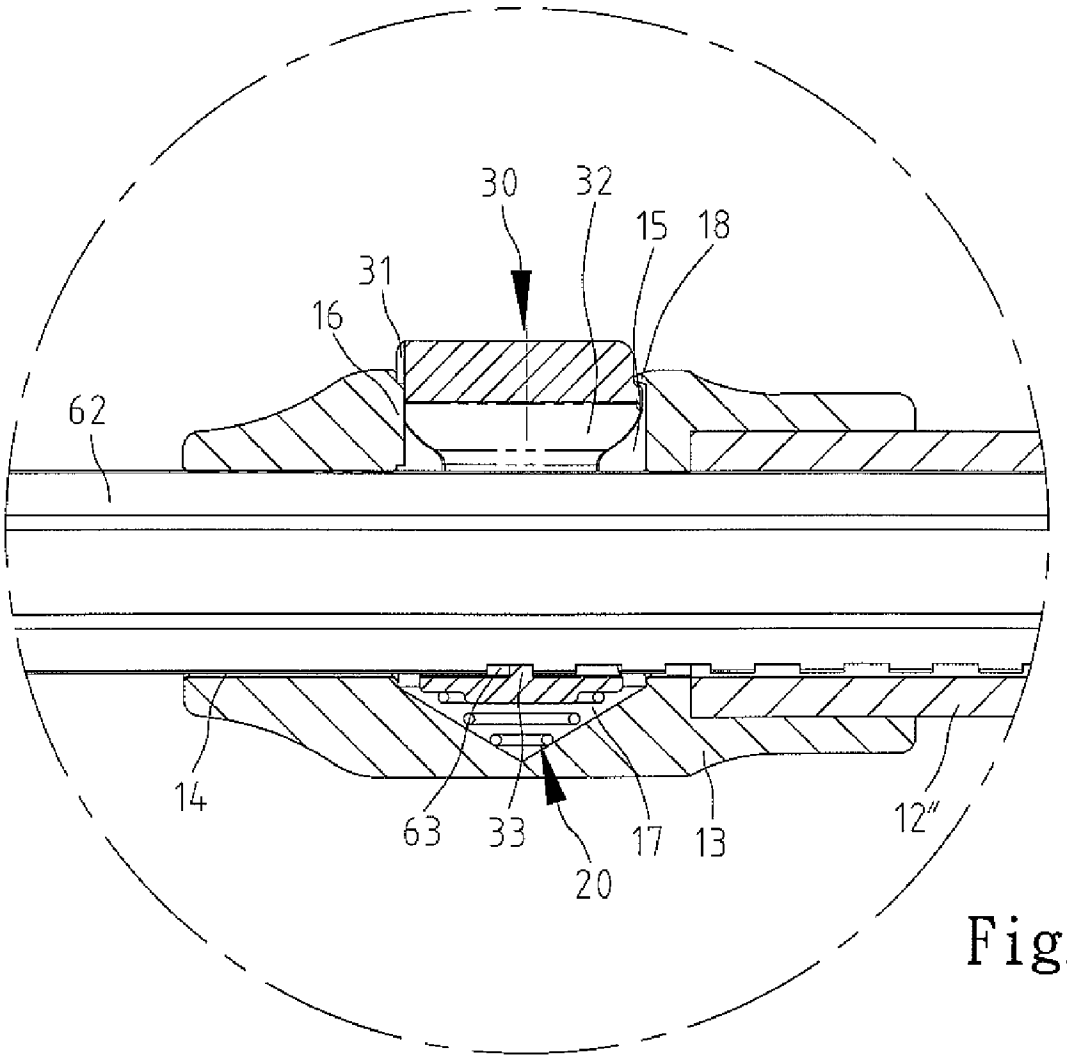
FIG. 8A is an enlarged, cross-sectional view of the tool in the encircled area A of FIG.8.
Figure 9:
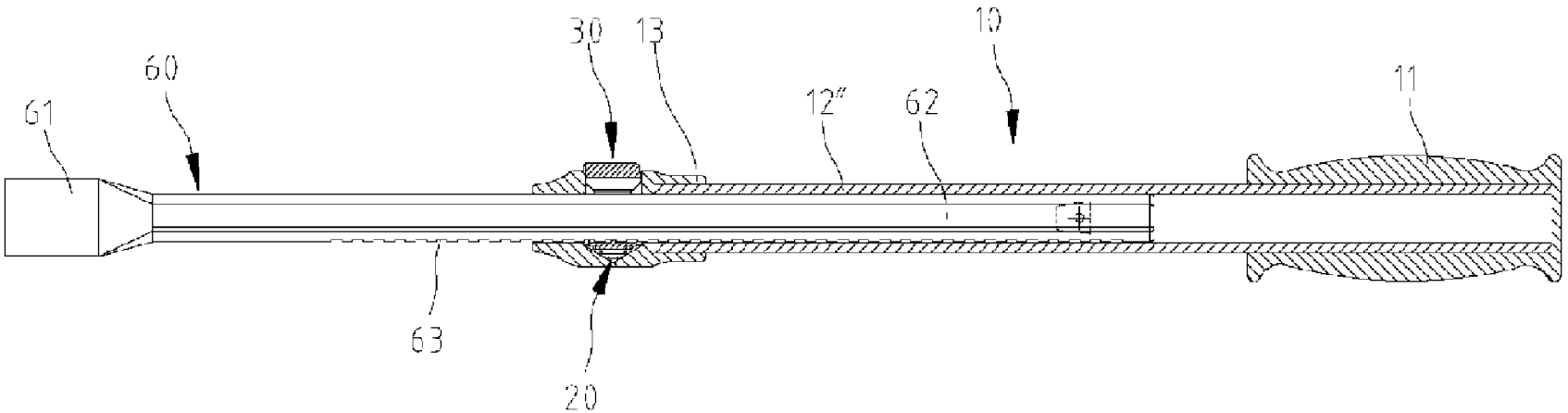
FIG. 9 is a cross-sectional view of the tool in another position than shown in FIG. 8.

Referring to FIGS. 8 and 9, there is shown a tool according to a third embodiment of the present invention. The third embodiment is like the first embodiment except for several things. Firstly, the socket 13 is made separate from the handle 11. Secondly, an extension pipe 12" is installed between the handle 11 and the socket 13. Thirdly, a bit 60 is used instead of the bit 40. The bit 60 includes a working tip 61 in the form of a screwdriver and an elongated shank 62 for insertion into the extension pipe 12". A plurality of recesses 63 is defined in the elongated shank 62. One of the recesses 63 receives the ridge 33 so as to position the bit 60.

The tool according to the present invention exhibits some advantages. Firstly, it includes only a few elements and forms a simple structure. Secondly, a user can easily operate the tool with only one hand.

The present invention has been described through the illustration of the preferred embodiments. Those skilled in the art can derive variations from the preferred embodiments without departing from the scope of the present invention. Therefore, the preferred embodiments shall not limit the scope of the present invention defined in the claims.

What is claimed is:

1. A tool comprising:

a socket formed by a single piece of homogenous material, with the socket defining an axial non-circular space of constant cross-sections extending in the socket, with the socket further defining a radial space of constant cross-sections extending in the socket and in communication with the axial non-circular space;

a controller comprising a passage defined therein and a locking ridge formed on a wall of the passage, wherein the controller is movable in the radial space of the socket between a locking position and a releasing position;

an elastic element pushing the controller to the locking position;

a handle connected to the socket; and a bit comprising a working tip and a shank of constant cross-sections of a size for slideable insertion in the axial non-circular space and the passage, with the shank defining at least one locking recess for receiving the locking ridge when the shank is inserted into the passage of the controller through the axial non-circular space of the socket, thus locking the bit to the socket.

2. The tool according to claim 1 wherein the elastic element is a spring.

3. The tool according to claim 2 wherein the spring is a conical spring.

4. The tool according to claim 3 wherein the socket further defines a radial taper cavity in communication with the radial space thereof so as to contain the conical spring.

5. The tool according to claim 1 wherein the socket comprises an anti-rotation ridge on a wall of the radial space, wherein the controller defines an anti-rotation recess receiving the anti-rotation ridge of the socket so as to prevent rotation of the controller in the radial space of the socket.

6. The tool according to claim 1 wherein the socket comprises a restraint integrally formed of the single piece of homogenous material and restraining the controller in the radial space.

7. The tool according to claim 6 wherein the restraint integrally is formed with the single piece of homogenous material by hammering a portion of the socket near the radial space of the socket.

8. The tool according to claim 1 wherein the axial non-circular space of the socket is a hexagonal space.

9. The tool according to claim 1 wherein an axis of the axial non-circular space of the socket is parallel to that of the handle.

10. The tool according to claim 9 wherein the working tip of the tool is a chisel.

11. The tool according to claim 10 wherein the handle comprises an anvil at an opposite end for encountering a hammer.

12. The tool according to claim 1 wherein an axis of the axial non-circular space of the socket is perpendicular to that of the handle.

13. The tool according to claim 12 wherein the working tip of the bit is a hammer.

14. The tool according to claim 13 wherein the handle comprises a hammer at an opposite end.

15. The tool according to claim 1 further comprising:

an extension pipe connecting the socket to the handle.

16. The tool according to claim 15 wherein the socket comprises an anti-rotation ridge on a wall of the radial space, wherein the controller defines an anti-rotation recess receiving the anti-rotation ridge of the socket so as to prevent rotation of the controller in the radial space of the socket.

17. The tool according to claim 15 wherein the socket comprises a restraint integrally formed of the single piece of homogenous material and restraining the controller in the radial space.

18. The tool according to claim 1 wherein one of the controller and the constant cross-sections of the radial space includes an anti-rotation ridge and of another of the controller and the constant cross-sections of the radial space includes an anti-rotation recess slideably receiving the anti-rotation ridge, with the slideable receipt of the anti-rotation ridge in the anti-rotation recess preventing rotation of the controller in the radial space.

19. The tool according to claim 18 wherein the radial space terminates in an outer portion of the socket; and wherein the socket comprises a restraint integrally extending into the constant cross-sections of the radial space at the outer portion, with the restraint constraining the controller in the radial space, with the restraint being hammered from the socket after formation of the radial space.

* * * * *